US005887042A

United States Patent [19]

Akamatsu et al.

[11] Patent Number: 5,887,042

[45] Date of Patent: Mar. 23, 1999

[54] CASK FOR A RADIOACTIVE MATERIAL AND RADIATION SHIELD

[75] Inventors: Hiroshi Akamatsu; Hiroaki Taniuchi, both of Takasago, Japan

[73] Assignee: Kabushiki Kaisha Kobe Seiko Sho, Kobe, Japan

[21] Appl. No.: 899,650

[22] Filed: Jul. 24, 1997

[30] Foreign Application Priority Data

Jul. 25, 1996 [JP] Japan ..... 8-196263

[51] Int. Cl.[6] ..... G21C 19/07; G21F 1/08

[52] U.S. Cl. ..... 376/272; 250/506.1; 252/478

[58] Field of Search ..... 376/272; 250/506.1, 250/507.1; 252/478, 520

[56] References Cited

U.S. PATENT DOCUMENTS 3,781,189 12/1973 Kasberg ..... 250/506.1
3,888,794 6/1975 Kasberg ..... 252/478
3,888,795 6/1975 Kasberg ..... 252/478

FOREIGN PATENT DOCUMENTS 0 119 781 9/1984 European Pat. Off. .
1 555 637 1/1969 France .

*Primary Examiner*—Charles T. Jordan
*Assistant Examiner*—M. J. Lattig
*Attorney, Agent, or Firm*—Oblon, Spivak, McClelland, Maier & Neustadt, P.C.

[57] ABSTRACT

A cask for a radioactive material has a single gamma ray and neutron shielding layer disposed on the outside of a vessel body, and the shielding layer is formed of the compact of a mixture of lead and a metal hydride dispersed therein. This cask can exhibit an excellent shielding effect according to the balance of radiation source intensity between gamma rays and neutrons, and can be made more compact.

14 Claims, 5 Drawing Sheets

CASK FOR A RADIOACTIVE MATERIAL AND RADIATION SHIELD

BACKGROUND OF THE INVENTION

1. Field of the Invention

This invention relates to a transport and/or storage cask for a radioactive material such as spent fuel or the like, and a radiation shield 2. Description of the Related Art A cask for a radioactive material such as spent fuel from a nuclear power plant or the like must shield gamma rays and neutrons emitted from the radioactive material and to effectively dissipate heat generated through the decay of a radioactive material such as spent fuel or the like contained therein. Examples of such a cask are disclosed, for example, in Japanese Patent Application Laid-Open No. 7-27896 (kokai) and Japanese Patent Application Publication No. 5-39520 kokoku).

A cask disclosed in Japanese Patent Application Laid-Open No. 7-27986 (kokai) has a gamma ray shielding lead layer interposed between an inner shell made of a steel plate and an outer shell made of a steel plate and a neutron shield disposed on the outer surface of the outer shell, so that gamma rays and neutrons emitted form a radioactive material are shielded by these two layers, respectively.

This cask is further provided with cooling fins disposed on the outer side of the neutron shield. The lead layer is closely brought into contact with the outer surface of the inner shell via a thin film of a lead-tin material, thereby efficiently dissipating outward heat generated within the inner shell, such as that resulting from decay of a radioactive material, so that a radioactive material such as spent fuel is transported safely in the cask.

A cask disclosed in Japanese Patent Application Publication No. 5-39520 (kokoku) is also based on the technical thought of shielding gamma rays and neutrons separately, wherein gamma rays emitted from a radioactive material are shielded by carbon steel, and neutrons by a neutron shield.

More specifically, it is composed of a cylindrical vessel made of carbon steel by which gamma rays are shielded, a plurality of metallic heat conductive members which are disposed adjacent to each other around the vessel and between the vessel and the outer shell, and a neutron shield material filing in each of closed spaces formed by the heat-conductive members and the outer shell. Each of the heat conductive members has an L-shaped cross-section and is composed of a portion which extends in the longitudinal direction of the vessel so as to contact the outer surface of the vessel and a portion which extends the radial direction of the vessel and whose end is attached to the inner surface of the outer shell.

The cask disclosed in Japanese Patent Application Laid-Open No. 7-27896 (kokai) has an advantage that the inner shell can be made thin because the lead layer having an excellent shielding capability against gamma rays is disposed between the inner and outer shells, and an advantage that heat generated within the inner shell, such as that resulting from decay of a radioactive material, can be efficiently dissipated outward because the lead layer closely contacts the outer surface of the inner shell via the thin film of a lead-tin material However, in order to attain a close contact between the lead layer and the outer surface of the inner shell, the lead layer is formed employing a so-called homogeinzing treatment comprising the steps of applying flux containing zinc chloride, stannous chloride, and the like to the outer surface of the inner shell; coating the outer surface with molten lead-tin material; assembling the inner and outer shells together; and casting lead between the inner and outer shells. As a result, the fabrication of the cask takes a longer period of time and involves higher costs.

Further, lead must be carefully cast between the inner and outer shells so as to not introduce defects such as voids, and after casting, the cask must undergo an ultrasonic inspection for such defects.

Moreover, heat generated during casting causes the inner and outer shells to deform, resulting in a nonuniform clearance between the inner and outer shells and thus forming a thinner portion in the thus-cast lead layer. It is therefore necessary to cast more lead than a required quantity corresponding to a required shielding thickness.

The cask disclosed in Japanese Patent Application Publication No. 5-39520 (kokpku) uses a vessel which is made of only carbon steel, thereby shielding gamma rays. When the vessel is made of only carbon steel, the thickness thereof must be considerably large to shield gamma rays because carbon steel is inferior to lead in terms of gamma ray shielding capability. Even though the vessel is relatively thick, the heat-conductive performance thereof is relatively good, and thus no problem arises with respect to heat; however, the vessel's capacity for containing a radioactive material reduces accordingly, resulting in a reduced storage efficiency.

The present inventors proposed, in Japanese Patent Applicaton No. 7-199594, a cask for a radioactive material having a gamma ray shielding layer and a neutron shielding layer disposed on the outer surface of an inner shell, as well as heat conductive members penetrating through the gamma ray shielding layer and neutron shielding layer, as a vessel having a high efficiency of storing a radioactive material and an excellent heat-conductive performance.

This transport/storage cask for a radioactive material, a transverse cross-secton of which is typically shown in FIG. 8, is composed of a vessel inner shell 1 having a basket 5 for containing a radioactive material, an outer shell 2, and a gamma ray shield layer 3 and a neutron shield layer 4 successively disposed between the vessel inner shell 1 and the outer shell 2.

According to this invention, the heat-conductive performance of the vessel is particularly excellent, compared with the above-mentioned prior arts, by the presence of the heat conductive members.

When it is required to shield both gamma rays and neutrons, as in a cask for spent fuel radiation source intensities of gamma rays and neutrons are differed depending on spent fuel, and it is important to effectively shield gamma rays and neutrons according to the balance of radiation source intensity between the both or the degree of intensity.

In the above-mentioned structures of the prior arts, since gamma rays and neutrons are shielded independently by a gamma ray shielding layer and a neutron shielding layer, respectively, it is difficult to design the material or thickness of each shielding layer according to the balance of radiation source intensity. Therefore, a conservative design such as thickening of the respective shielding layers is needed, resulting in an increase in size of the vessel, and construction of the shielding layers and the heat conductive members is obliged to be complicated.

SUMMARY OF THE INVENTION

This invention has been achieved to solve the above-mentioned problems. An object of this invention is to provide a cask for a radioactive material which can exhibit an excellent shielding effect according to the balance of radiation source intensity between gamma rays and neutrons or the degree of intensity, and can be made more compact or contain a greater quantity of a radioactive material with the same size.

In order to attain the above objective, the cask for a radioactive material according to this invention comprises a gamma ray and neutron shielding layer disposed around a vessel body, the shielding layer being composed of a single shielding layer formed of a mixture of lead and a metal hydride dispersed therein.

The single shielding layer referred herein means that it has a simplified function for shielding both gamma rays and neutrons, and is employed in order to be discriminated from a one having a plurality of shielding layers bearing part of function or role of shielding effects to gamma rays and neutrons, respectively, as the conventional shielding layers.

In other words, when the shielding layer of this invention is provided on the vessel body, or used as a radiation shield, pluralization (pluralization of a shielding layer having the same function) in the sense of providing or using a block formed of a mixture of lead and powder of a metal hydride mixed and dispersed therein in the form divided into a plurality of pieces in the longitudinal direction or thickness direction thereof is included within the range of this invention.

It is known that lead and a metal hydride such as titanium hydride, ziconium hydride or the like are effective for shielding gamma rays and neutrons, respectively.

Particularly, titanium hydride is an effctive material as neutron shield with a high hydrogen content, in theory, per unit volume. However, a metal hydride such as titanium hydride is, in general, inevitably provided in powdery state because of the very manufacturing process. Therefore, it has such an extremely low bulk density of about 30% of the theoretical density, and it can not be molded to a density that could be applicable for a neutron shield by general press molding.

Although it was also attempted to mold titanium hydride powder into a plate having a density of 90% or more of the theoretical density by applying a pressure of several thousands tons by a large-size press, this method was not practically employed because of an extremely high fabrication cost including the pressing itself, and pretreatment and post-treatment thereof.

This invention has solved the above-mentioned problem by dispersing a metal hydride such as titanium hydride into lead.

To be concrete, the dispersion of a metal hydride into lead can be executed by (1) mixing the powder of metal hydride to molten lead to disperse it into lead, (2) mixing powdery lead and the powder of metal hydride together and dispersing the powder of metal hydride into the lead powder allowed by compression molding, or the like.

The compact of a mixture of lead and a metal hydride dispersed therein means that the mixture is molded (blocked) into the application form within a cask of the gamma ray and neutron shielding layer.

In the above-mentioned method (1), lead may be molten in a die having the application form of the gamma ray and neutron shielding layer, to which a metal hydride is mixed followed by cooling and coagulation, or the mixture may be cooled and coagulated followed by molding into the application form of the gamma ray and neutron shielding layer.

When a metal hydride is added to molten lead, it is necessary to take a measure of adding the metal hydride while sufficiently stirring molten lead or of laying the metal hydride to be added into the form of mixture in order to uniformly disperse the metal hydride into the lead, because the both are differed in specific gravity.

While a metal hydride generally has the characteristic of decomposing under conditions of a temperature of 400° C. and a vacuum, lead has a low melting temperature as 300°–400° C. Therefore, even when the powder of metal hydride is mixed to molten lead in the method (1), a mixture having the metal hydride uniformly dispersed in lead can be provided without decomposing the metal hydride.

In the method (2), the mixture of lead and a metal hydride may be molded into the application form of the gamma ray and neutron shielding layer in compression molding, or may be worked into the application from by cutting or the like after compression molding.

In compression molding, powders of lead and a metal hydride are mixed together to penetrate the lead powder into cavities formed between the mutual metal hydride powders followed by compression molding of mixture. According to this method, the pressure needed to press mold is less than for press molding metal hydride alone. This is because the presence of lead makes the mixture soft and easy to mold. The final bulk density of this mixture is increased in comparison to the hydride alone.

The thus-obtained mixture of lead and a metal hydride powder dispersed therein can form a practical compact in respect of density and strength, and also can provide a single shielding material having the function of shielding both gamma rays and neutrons.

Namely, this invention satisfies both the fabrication of a shield that could be applicable to practical use in respect of density and strength and improvements in function of a shield for shielding both gamma rays and neutrons.

Compared with the thus-obtained shield according to this invention, a compact obtained by mixing powdery lead with a powdery metal hydride followed by kneading and molding by use of a binder such as resin or rubber has a problem of deterioration in the use as shield because of the low heat resisting temperature and durability of the inevitably used binder.

This method is not still realistic in the point that the bulk density of the compact can not be increased to a density resistant to use as the above-mentioned lead by general press molding even by the use of resin or rubber.

BRIEF DESCRIPTION OF THE DRAWINGS

FIG. 7 is a view illustrating a block of a gamma ray shielding layer according to the embodiment, wherein

DESCRIPTION OF THE PREFERRED EMBODIMENTS

In the gamma ray and neutron shielding layer in this invention, a metal hydride is preferably mixed to lead within a range of 15–100% if (all percentages are weight persent) in order to make lead and the metal hydride exhibit respective gamma ray and neutron shielding effects in maximum.

The meaning of this mixing ratio of lead to a metal hydride is then illustrated. The simulation results of the relation between mixing ratio of titanium hydride to lead and shielding effect to gamma rays and neutrons are shown in FIG. 1 for a transport cask for a radioactive material and in FIG. 2 for a storage cask for a radioactive material, respectively.

The simulation was performed under the following conditions; (1) vessel: those having the vessel structure shown in FIG. 4 with a height (length) of 5200 cm and a diameter of 2450 cm for both the transport cask and the storage cask, (2) radioactive material to be contained: spent fuel of a pressurized water reactor (PWR) with a cooling period of 2 years (transport cask) and 10 years (storage cask), (3) calculation code: one-dimensional shield calculation code (ANISN) used in designing and safety analysis of cask, (4) shielding effect to gamma rays and neutrons: measured by the radiation dose rate at 1 m from the surface of the vessel side surface center part.

Figure 1:
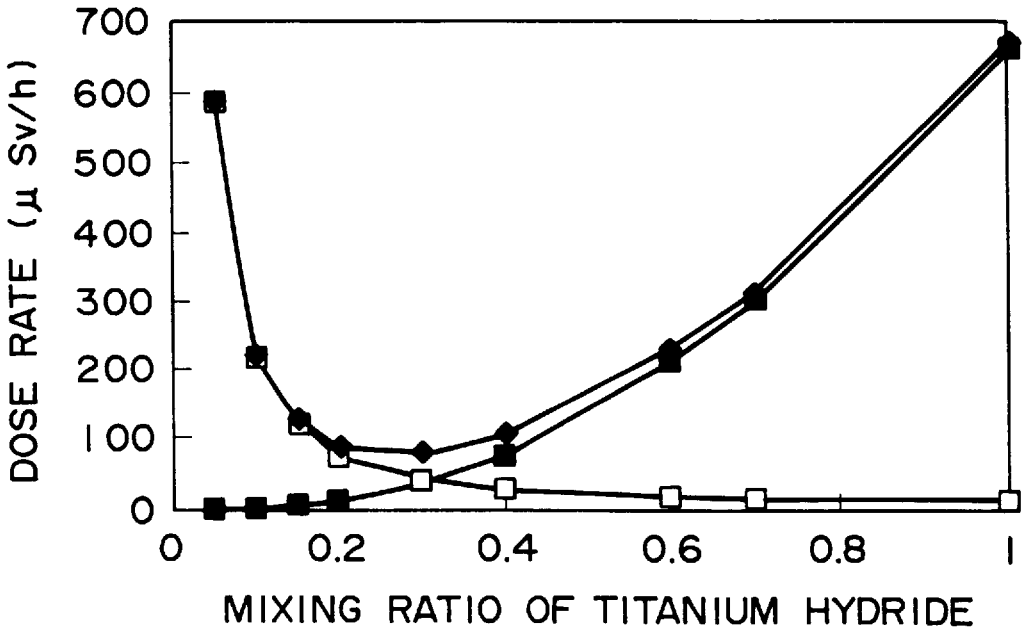
FIG. 1 is a view illustrating the relation between mixing ratio of titanium hydride to lead and shielding effect to gamma rays and neutrons in the application of a radiation shield according to an embodiment of this invention to a transport cask for a radioactive material.

In FIG. 1, reference marks ■,□ and ♦ denote dose rates of gamma rays, neutrons, and the total of gamma rays and neutrons, respectively.

As is apparent from FIG. 1, neutron dose rate is sharply increased with a mixing ratio of titanium hydride to lead less than 15%, while gamma ray dose rate is sharply increased with above 50%. It is found from the same figure that the optimum mixing range of titanium hydride to lead where the dose rates of gamma rays and neutrons are less than 100 $\mu$Sv/h is 20–40%.

Figure 2:
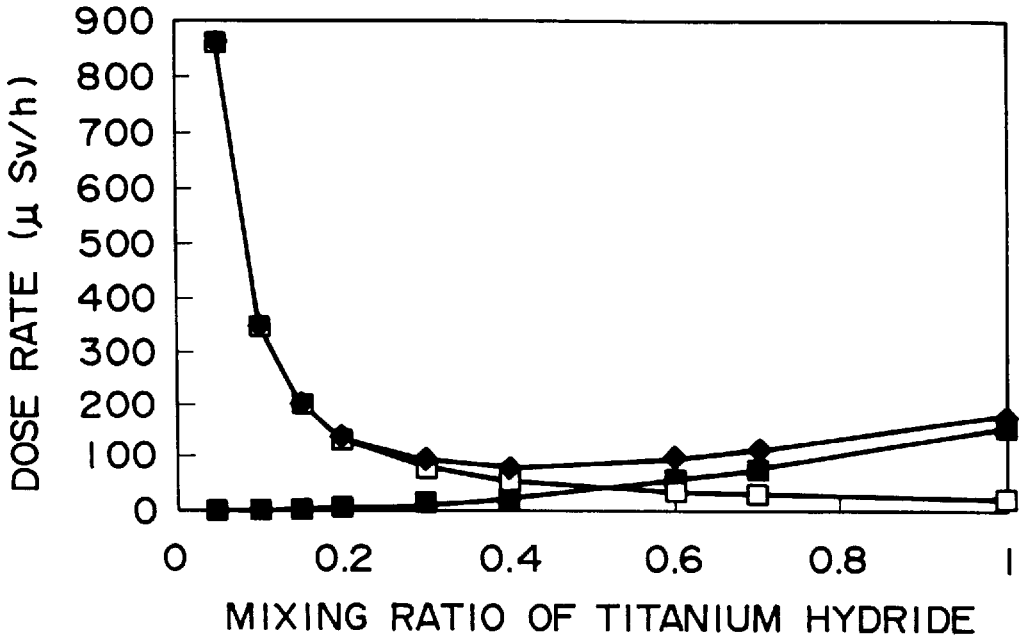
FIG. 2 is a view illustrating the relation between mixing ratio of titanium hydride to lead and shielding effect to gamma rays and neutrons in the application of the radiation shield according to the embodiment to a storage cask for a radioactive material.

In FIG. 2, reference marks ■,□, and ♦ denote dose rates of gamma rays, neutrons, and the total of gamma rays and neutrons, respectively.

As is apparent from FIG. 2, neutron dose rate is sharply increased with a mixing ratio of titanium hydride to lead less than 20%, while gamma ray dose rate is not so much sharply increased up to 100%. It is found from the same figure that the optimum mixing ratio range of titanium hydride to lead where the dose rates of gamma rays and neutrons are less than 100 $\mu$Sv/h is 30–60%.

Considering two typical cases of a transport cask for a radioactive material and a storage cask for a radioactive material, the mixing ratio of titanium hydride to lead within a range of 15%–100% is adaptable, and the optimum range is 20–60%.

Since the cost of titanium hydride to lead is high, titanium hydride is used more economically with a lower mixing ratio within this optimum range.

Further, other metal hydrides such as zircnium hydride or the like also have the same tendency. Of metal hydrides, titanium hydride is preferably used from the points of excellent neutron shielding effect and availability.

From FIGS. 1 and 2, it is found that the optimum mixing ratio of titanium hydride to lead is varied between a transport cask for a radioactive material and a storage cask for a radioactive material, because the radioactive material to be contained and the balance of quantity of gamma rays and neutrons are differed between the both.

This means that it is important to shield gamma rays and neutrons according to the balance of radiation source intensity between the both when it is needed to shield both gamma rays and neutrons as in a cask for spent fuel.

Each of the prior arts having a shielding layer divided into a gamma ray shielding layer and a neutron shielding layer substantiates the statement of the present inventors that the material or thickness of each shielding layer is difficult to design according to the balance of radiation source intensity.

Furthermore, the shield according to this invention is suitably used as a shield for gamma rays and neutrons, particularly, generated from nuclear power facilitates, radiation generating devices, and equipments having radiation sources.

Although a mixture of silicone rubber and powder of lead or tungsten was employed in the past as a shield of this kind, (1) it had a problem that it was not usable under a high temperature because silicone rubber has a low heat resisting temperature, and (2) an absorbing margin for thermal expansion taking the high temperature of the shield in a cask into consideration was required in construction because of its high thermal expansion coefficient, and this absorbing margin had a possibility of causing a radiation leak (streaming). The above-mentioned inconveniences are solved by the use of the shield according to this invention.

A preferred embodiment of a trasport/storage cask for a radioactive material according to this invention is illustrated in reference to FIGS. 3–6.

Figure 3:
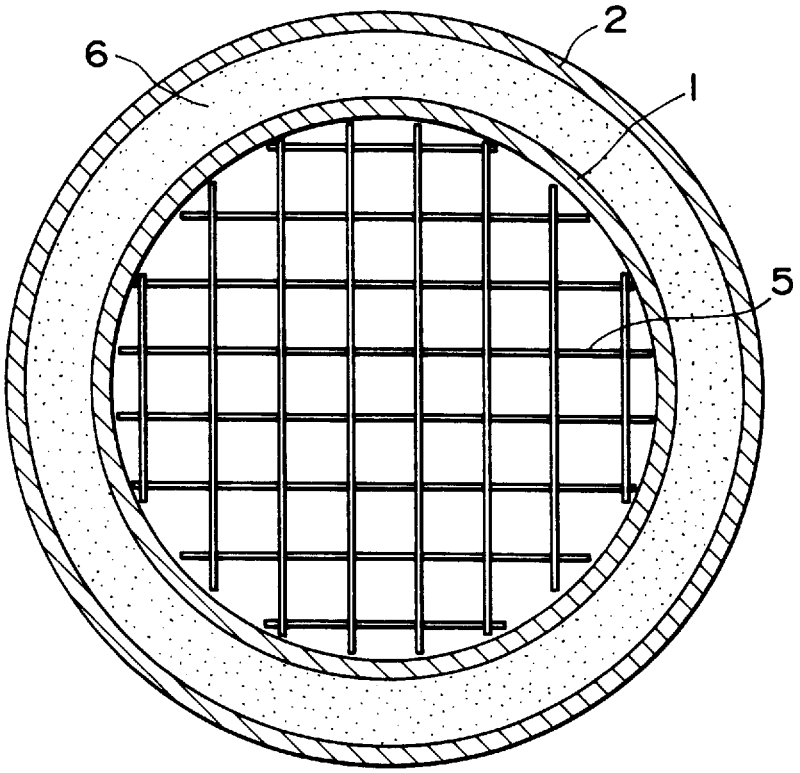
FIG. 3 is a transverse cross section of a cask for a radioactive material according to another embodiment of this invention.
Figure 8:
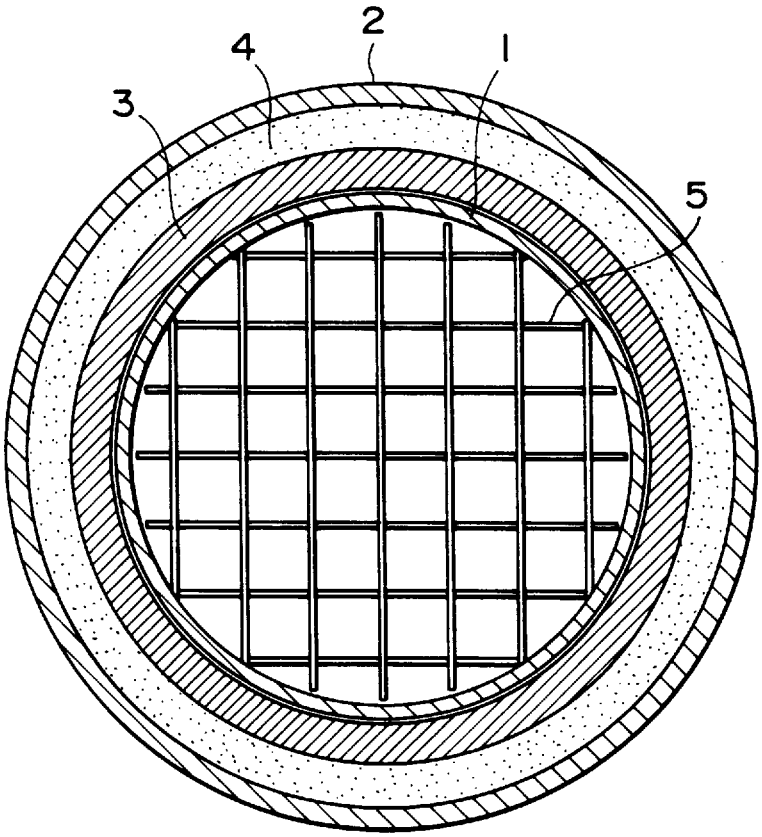
PRIOR ART FIG. 8
FIG. 8 is a transverse cross-setion of a conventional transport/storage cask for a radioactive material.

FIG. 3 typically shows a transverse cross-section of a cask for a radioactive material according to the embodiment of this invention, which corresponds to FIG. 8 showing the above-mentioned prior art.

Figure 4:
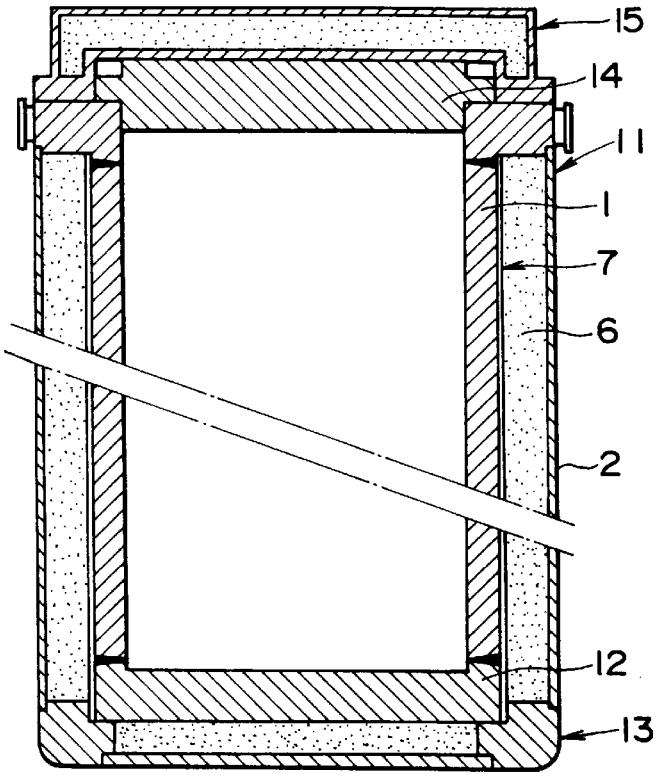
FIG. 4 is a longitudinal cross-section of the cask for a radioactive material according to the embodiment.
Figure 5:
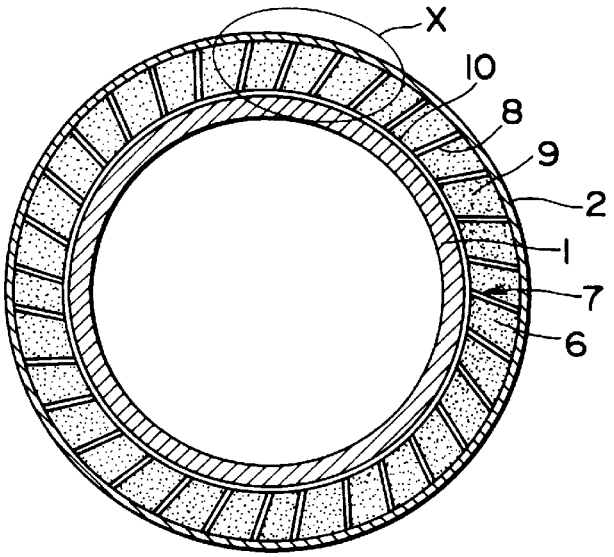
FIG. 5 is a transverse cross-section of the cask of FIG. 4
Figure 6:
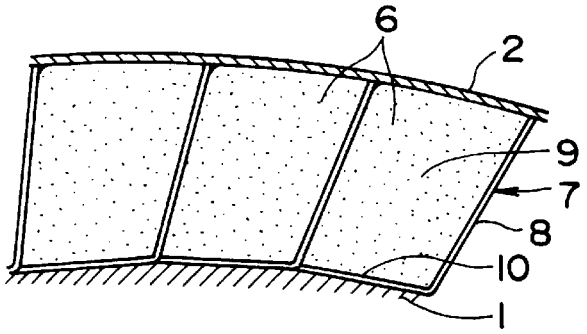
FIG. 6 is an enlarged view of portion X of FIG. 5.

FIG. 4 is a longitudinal cross-section of the cask, FIG. 5 is a transverse section of the cask of FIG. 4, and FIG. 6 is an enlarged sectional view of part X of FIG. 5. in the figures, reference numeral 1 denotes an inner shell, reference numeral 2 denotes an outer shell and reference numeral 6 denotes a single shielding layer of gamma rays and neutrons.

The inner shell 1 and the outer shell 2 are made of steel and cylindrical and the inner diameter of the outer shell 2 is greater by a predetermined value than the outer diameter of the inner shell 1. The inner shell 1 has the smallest thickness which allows the vessel to be hermetically sealed. By adapting such a minimum required thickness, the efficiency of storing a radioactive material is improved, and the weight of the whole cask can be reduced.

In this embodiment, the same heat conductive members 7 as in Japanese Patent Application No. 7-199594 described above are provided in order to further improve heat conductive characteristic. Each of the heat conductive members 7 is a relatively lengthy member formed by bending a metallic sheet, such as that of copper or aluminum, having good heat conductivity into a relatively elongated shape having an L-shaped cross-section. The heat-conductive member 7 is disposed around the inner shell 1 in the following manner: side portions 8 of the L-shaped cross-section are arranged at a predetermined pitch along the outer circumference of the inner shell 1; a surface extending longitudinal from each side portion 8 contacts the outer surface of the inner shell 1 under pressure; and the end of another side portion 8 is welded to the inner surface of the outer shell 2.

By mounting the heat conductive members 7 in this way, a space 9 defined by the side portions 8 is armed between the inner shell 1 and the outer shell 2. The heat generated within the inner shell 1 is transferred efficiently to the outer shell 2 via the heat-conductive members 7, and dissipated outwardly from the outer shell 2. Instead of being contacted to the outer surface of the inner shell 1 under pressure, the surface extending longitudinally from the side portion 10 may be mounted closely to the outer surface by bolting, brazing or the like.

The gamma ray and neutron shielding layer 6 is formed of blocks, each having a thickness required to shield gamma rays. Each block has a cross-sectional shape to fit into a corresponding portion, located adjacently to the outer surface of the inner shell 1, of the space 9 with a length substantially equal to the length of the space 9. The blocks are inserted into the space 9.

When the necessary thickness of the shielding layer in this embodiment is compared with that of the shielding layer divided into two gamma ray and neutron shielding layers as in the past, a thickness in total of 27 cm of a gamma ray shielding layer of 15 cm and a neutron shielding layer of 12 cm is necessary in the conventional example of FIG. 8, while the single shielding layer 6 of this embodiment has a thickness of 22 cm, and the weight of the cask can be reduced in this invention.

The reduction in weight of the cask reversely leads to an increase in the storage capacity of a radioactive material the number of fuel assemblies can be increased to 37 in this embodiment against 32 in the conventional example, and the storage capacity can be increased by about 20%.

At the bottom opening of a cylindrical vessel body 11 having the above-mentioned structure, an inner bottom 12 made of the same material as that of the inner shell 1 is welded to the inner shell 1, and an outer bottom (protective bottom) 13 is mounted so as to cover the inner bottom 12. At the top opening of the cylindrical vessel body 11, an inner lid 14 made of the same material as that of the inner shell 1 or of stainless steel or the like is mounted, and an outer lid (protective cover) 15 is mounted so as to cover the inner lid 14.

In the transport/storage cask for a radioactive material having the above-mentioned structure, gamma rays and neutrons emitted form a radioactive material contained within the vessel are shielded by the singe layer of the gamma ray and neutron shielding layer 6 disposed outside the inner shell 1. Thus, the inner shell 1 may have a minimum thickness required to function as a pressure vessel thereby improving the efficiency of storage of a radioactive material.

Since the heat-conductave members 7 penetrate through the gamma ray and neutron shielding layer and are disposed between the inner shell 1 and the outer shell 2, heat resulting from decay of a radioactive material contained within the vessel is transferred efficiency via the heat-conductive members 7 from the inner shell 1 to the outer shell 2. Thus, it is not necessary to improve the heat-conductive performance of the gamma ray and neutron shielding layer 6 by a special treatment such as the homogenizing treatment, thereby facilitating the fabrication of the cask and reducing fabrication cost.

The gamma ray and neutron shielding layer 6 can be preliminary formed as blocks, as described above, by (1) mixing powder of a metal hydride into molten lead to disperse it into lead, or (2) mixing powdery lead and powder of metal hydride together followed by compression molding.

The shielding layer 6 can be thus constructed by a simple method of inserting the blocks into the space 9. Therefore, it is not necessary to cast, at a shop, the materials of the gamma ray and neutron shielding layer 6, but the blocks can be previously produced at a dedicated casting shop. This is suited for mass production and facilitates to the work for forming the gamma ray and neutron shielding layer 6, thereby advantageously reducing fabrication cost.

Each block of the gamma ray and neutron shielding layer 6 may be divided in the longitudinal direction thereof into sub-blocks, each having a predetermined length. In this case, since the length of sub-blocks is shorter than that of the blocks, the sub-blocks are more readily produced as the above-mentioned dedicated casting shop.

Figure 7A:
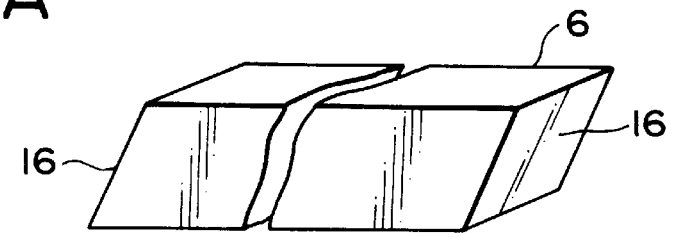
FIG. 7*a* is a view illustrating a block having slant ends for joint.
Figure 7B:
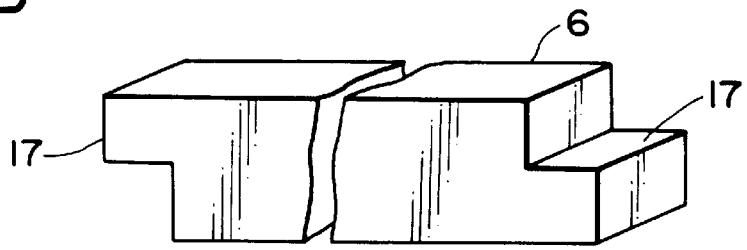
FIGS. 7*b* and 7*c* are views illustrating a block having rabbeted ends for joints.
Figure 7C:
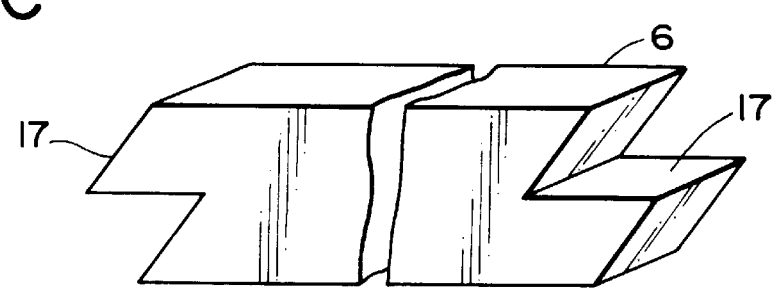

In order to prevent the steaming of radiation, a longitudinal end of each sub-block has a slant surface 16 as shown in FIG. 7*a* or a rabbeted surface 17 as shown in FIGS. 7*b* and 7*c*.

According to the embodiment described above, the vessel body 11 is cylindrical. This invention is not limited thereto, but the vessel body 11 may have a rectangular or polygonal shape.

According to the embodiment described above, the gamma ray and neutron shielding layer has a uniform thickness in the longitudinal direction of the vessel. This invention is not limited thereto, but upper and lower end blocks may be thicker than intermediate blocks.

In other words, when the gamma ray and neutron shielding layer 6 is formed of blocks, the thickness can be easily varied in the longitudinal or circumferential direction of the vessel according to the distribution of radiation sources of a radioactive material contained within the vessel.

As described so far, the transport/storage cask for a radioactive material according to this invention can be relatively easily manufactured, thereby suppressing fabrication cost, and it is also capable of containing a radioactive material at an enhanced efficiency, exhibits excellent heat conductive performance, and effectively shields gamma rays and neutrons.

We claim:

1. A cask for radioactive material comprising:

an inner shell;

an outer shell;

a single shielding layer arranged between said inner shell and said outer shell for shielding both gamma rays and neutrons, said shielding layer being formed of a compact of a mixture of lead and a metal hydride dispersed therein, said shielding layer being formed in blocks having a shape to fit between said inner shell and said outer shell.

2. A radiation shield for shielding both gamma rays and neutrons, said radiation shield being formed of a compact of a mixture of lead and a metal hydride dispersed therein, the metal hydride being mixed in a ratio of 15%–100% by weight to lead, said radiation shield being made of preformed blocks.

3. The cask as defined in claim 1, wherein said blocks are formed of sub-blocks where a longitudinal end of each sub-block has a surface which prevents streaming of radiation.

4. The radiation shield as defined in claim 2, wherein said blocks are formed of sub-blocks where a longitudinal end of each sub-block has a surface which prevents streaming of radiation.

5. The cask as defined in claim 1, further comprising L shaped heat-conductive members extending from said inner shell to said outer shell between said blocks.

6. The radiation shield according to claim 2, further comprising heat conductive members extending between said blocks.

7. The cask as defined in claim 1, wherein the metal hydride is mixed in a ratio of 15%–100% by weight to lead.

8. The cask as defined in claim 1, wherein the metal hydride is mixed in a ratio of 20%–60% by weight to lead.

9. The cask as defined in claim 1, wherein the metal hydride is titanium hydride.

10. The radiation shield as defined in claim 2, wherein the metal hydride is mixed in a ratio of 20%–60% by weight to lead.

11. The radiation shield as defined in claim 2, wherein the metal hydride is titanium hydride.

12. The cask as defined in claim 7, wherein the metal hydride is titanium hydride.

13. The cask as defined in claim 8, wherein the metal hydride is titanium hydride.

14. The radiation shield as defined in claim 10, wherein the metal hydride is titanium hydride.

* * * * *